United States Patent [19]

Hanyu et al.

[11] Patent Number: 4,577,576

[45] Date of Patent: Mar. 25, 1986

[54] STITCHING ADJUSTMENT DEVICE OF A SEWING MACHINE

[75] Inventors: Susumu Hanyu; Kenji Kato, both of Tokyo, Japan

[73] Assignee: Janome Sewing Machine Co., Ltd., Tokyo, Japan

[21] Appl. No.: 644,126

[22] Filed: Aug. 23, 1984

[30] Foreign Application Priority Data

Sep. 5, 1983 [JP] Japan ..... 58-136694[U]

[51] Int. Cl.[4] ..... D05B 3/02

[52] U.S. Cl. ..... 112/456; 112/277

[58] Field of Search ..... 112/158 E, 277, 453, 112/455, 456, 220, 221

[56] References Cited

U.S. PATENT DOCUMENTS 4,299,182 11/1981 Tanaka ..... 112/277

4,401,042 8/1983 Hanyu et al. ..... 112/158 E

*Primary Examiner*—Peter Nerbun

*Attorney, Agent, or Firm*—Michael J. Striker

[57] ABSTRACT

A stitching adjustment device for a sewing machine having a stitching width adjusting device for controlling a pattern forming device by means of an electronic control device, the stitching adjustment device consisting of a means for adjusting amplitude external from the sewing machine and a means for detachably connecting the amplitude adjusting means with the electronic control device so that when connected the amplitude adjusting means controls the stitching instead of the stitching width adjusting device.

2 Claims, 2 Drawing Figures

STITCHING ADJUSTMENT DEVICE OF A SEWING MACHINE

FIELD OF THE INVENTION

This invention relates to a stitching adjustment device of a sewing machine which stores stitch control signals in an electronic memory, and produces stitched patterns.

BACKGROUND OF THE INVENTION

Stitching amplitude is in general controlled by operating thumbs provided at a front part of a head of the sewing machine. When embroidery stitching or pattern stitching are performed, a large operating portion is necessary for heightening operability of the control. However, this kind of sewing machine is of multi-functions, and it is difficult to furnish operating levers for adjustment at the head of the sewing machine due to problems of a furnishing space or structural conditions of printed electronic parts and operating parts thereof. The manual operation of the lever causes inconvenience in handling the fabric during operation.

SUMMARY OF THE INVENTION

The present invention to solve such problems as mentioned above, in which an amplitude adjusting device of an external control system is prepared which has a connector via a lead wire and is operated by foot stepping, independently of a stitching width adjusting device provided at the head of the sewing machine for adjusting amplitude under stitching, and which is detachably attached to the head of the sewing machine through said connector, and works when connected to the head of the sewing machine, in place of the stitching width adjusting device provided at the head of the sewing machine.

DETAILED DESCRIPTION OF THE PREFERRED EMBODIMENT OF THE INVENTION

Figure 1:
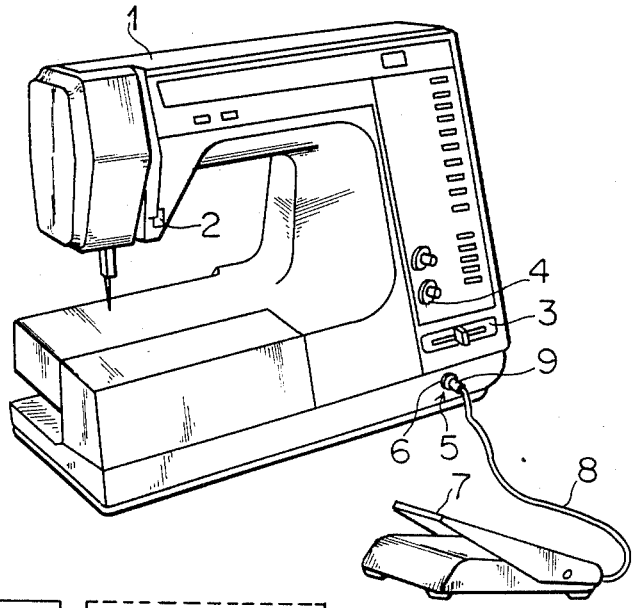
FIG. 1 is a sewing machine bearing an embodiment of the invention.

An embodiment will be explained in reference to the attached drawing. FIG. 1 shows a sewing machine provided at a front part of a head thereof with a switch 2 for driving and stopping the sewing machine, a speed control device 3, an adjusting device 4 for adjusting stitching width, and a connecting end 6 for receiving one end of a connector 5.

An amplitude adjusting device 7 of an external control system is for adjusting stitching amplitude by a foot stepping operation, and has the other connecting end 9 of the connector 5. When the connecting ends 6 and 9 are connected to each other, the external control system amplitude adjusting device 7 is operated in place of the stitching width adjusting device 4.

Figure 2:
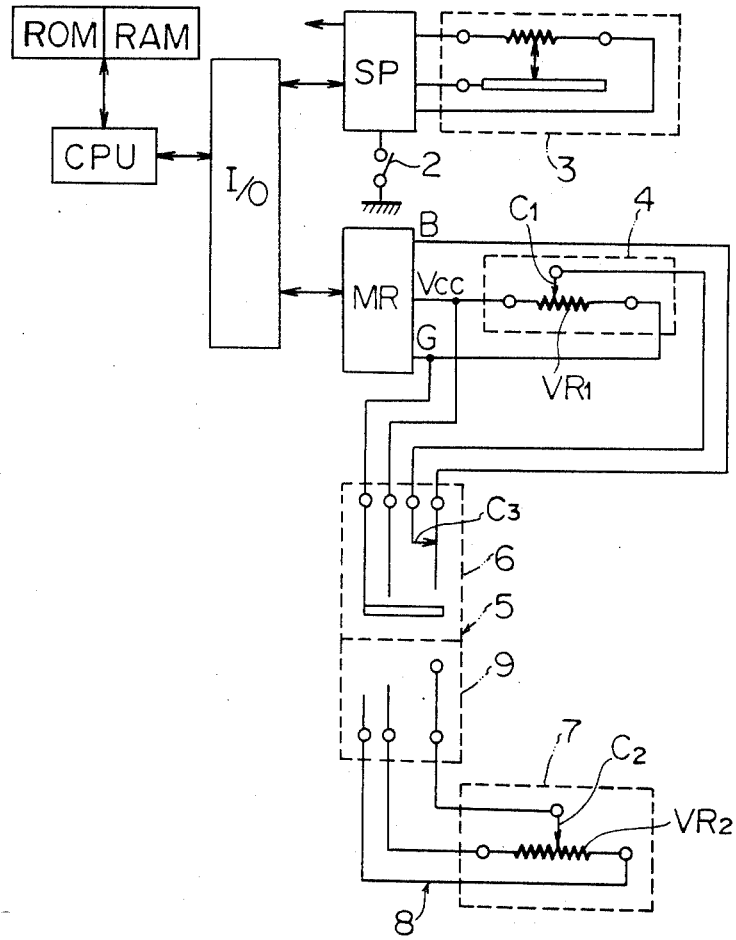
FIG. 2 is a control circuit of the same.

In FIG. 2, an electronic memory (ROM) stores stitch control signals, program control signals and others, and together with a central processing unit (CPU), a random access memory (RAM) and input-output port (I/O) forms a micro-compouter.

A speed control circuit (SP) is provided for controlling speed of a machine motor (not shown), and is designated of driving when the switch 2 is ON and is designated of speed by the speed control device 3, and gives control information thereof to CPU.

A stitching width adjusting manual circuit (MR) is designated of adjusting values by means of the stitching width adjusting device 4 to adjust stitching width, and give control informations thereof to CPU.

With respect to the adjusting device 4, a variable resistor (VR1) is connected to a plus electric source (Vcc) and a ground (G) with its both ends, and gives electric potential of adjusting value to be received by a connecting piece (C1) to a control input terminal (B) of the manual circuit (MR).

One connecting end of the connector 5 has connecting pieces which are respectively connected to the electric source (Vcc), ground (G), connecting piece (C1) and control input terminal (B), and the connector makes a connection between the connecting piece (C1) and the control input terminal (B) via a connecting piece (C3) when it does not have a connection with the other connecting end 9.

With respect to the external control system amplitude adjusting device 7, both ends of a variable resistor (VR2) and a connecting piece (C2) are connected to the other connecting end 9 of the connector 5 via lead wires 8. When the connecting end 9 is connected to the connecting end 6, both ends of the variable resistor (VR2) are connected to the electric source (Vcc) and the ground (G). The control input terminal (B) and the connecting piece (C1) are separated by the connecting piece (C3) by connection of the connecting piece (C2) to the control input terminal (B).

A next reference will be made to service of the above mentioned structure. If the connecting ends 6 and 9 are not connected, the connecting piece (C3) connects the connecting piece (C1) of the variable resistor (VR1) of the adjusting device 4 with the control input terminal (B) of the manual circuit (MR). Therefore, the stitching width is adjusted by moving the connecting piece (C1) by the hand manual operation.

If the connecting ends 6 and 9 are connected, the connecting piece (C3) breaks the connection between the connecting piece (C1) and the control input terminal (B), and instead the connecting piece (C2) of the amplitude adjusting device 7 is connected to the terminal (B). Thus, the stitching width is adjusted by moving the connecting piece (C2) by the foot stepping operation.

According to the invention, the external system amplitude adjusting device is made detachably connected with respect to the front part of the head of the sewing machine by means of the easy structure, and the stitching width adjusting device and its function are switched each other, so that operability is excellent while the sewing machine is driven as handling the fabric such as an embroidery stitching, and there is no structural problem in the area around the head part.

While the invention has been illustrated and described as embodied in a stitching adjustment device of a sewing machine, it is not intended to be limited to the details shown, since various modifications and structural changes may be made without departing in any way from the spirit of the present invention.

Without further analysis, the foregoing will so fully reveal the gist of the present invention that other can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a sewing machine comprising a stitch forming device; an electronic control device including a memory storing stitch control signals which may be selectively read out to control said stitch forming device to produce a selected pattern of stitches; means (3) for controlling a rotation speed of an electric motor for driving said sewing machine, said means being connected to said electronic control device and said motor by a speed control circuit; and means (4) for adjusting the amplitude of the stitches, said amplitude adjusting means being connected to said electronic control device by an amplitude adjusting circuit, the improvement comprising an external foot-operated controller for adjusting the amplitudes of the stitches, said foot-operated controller being positioned separately from said sewing machine; a first group of lead wires each having one end connected to said electronic control device through said amplitude adjusting circuit; a second group of lead wires each having one end connected to said foot-operated controller; and connector means including a first connector and a second connector, said first connector being provided on said sewing machine and holding an opposite end of each lead-wire of said first group, said second connector holding an opposite end of each lead wire of said second group, said second connector being detachably-connectable to said first connector so as to connect said foot-operated controller to said electronic control device through said amplitude adjusting circuit by said first and second groups of lead wires and disconnect said amplitude adjusting means from said electronic control device.

2. The sewing machine as defined in claim 1, wherein said controller is a foot-operated switch which includes a variable resistor which causes the stitching width to be adjusted as a resistance of said resistor is varied.

* * * * *